US005457837A

United States Patent [19]

Zuckerbrod

[11] Patent Number: 5,457,837

[45] Date of Patent: Oct. 17, 1995

[54] PORTABLE TRACKS FOR A WHEELCHAIR

[76] Inventor: Pamelia Zuckerbrod, 99-33 Westview Dr., Apt. 416, Coral Springs, Fla. 33076

[21] Appl. No.: 184,289

[22] Filed: Jan. 21, 1994

[51] Int. Cl.[6] ..... E01D 15/12

[52] U.S. Cl. ..... 14/69.5; 404/40; 404/41; 238/10 R

[58] Field of Search ..... 404/34, 35, 39, 404/40, 41, 50; 14/2.4, 69.5; 52/33, 174, 177; 238/10 R, 14

[56] References Cited

U.S. PATENT DOCUMENTS

| | | | |
|---|---|---|---|
| 3,820,912 | 6/1974 | Hughes | 404/35 |
| 4,176,982 | 12/1979 | Boswell | 404/34 |
| 4,254,907 | 3/1981 | Pine | 238/14 |
| 4,376,596 | 3/1983 | Green | 404/35 |
| 4,528,711 | 7/1985 | Packer | 14/69.5 |
| 4,681,482 | 7/1987 | Arciscewski et al. | 404/35 |

*Primary Examiner*—Ramon S. Britts
*Assistant Examiner*—Pamela A. O'Connor
*Attorney, Agent, or Firm*—Collard & Roe

[57] ABSTRACT

A portable track device for a wheelchair includes at least two track sections which can be coupled removably to each other, and each track section has a bottom channel between a right sidewall and a left sidewall, with a reinforcement rod in each sidewall and with transverse supports located in the bottom channel. Each track section is equal to, or greater than, the length of the wheelchair. The occupant of the wheelchair can travel safely across difficult terrain, such as a sandy beach.

12 Claims, 3 Drawing Sheets

PORTABLE TRACKS FOR A WHEELCHAIR

BACKGROUND OF THE INVENTION

1. Field of the Invention

The present invention relates to a portable track device for a wheelchair which enables the occupant of the wheelchair to travel safely across difficult terrain, such as sand at a beach.

2. The Prior Art

Difficult terrain such a sandy beach limits the mobility of a person in a wheelchair who may wish to travel across the sand. Attempts have been made in the past to solve similar problems, and prior proposals are as follows.

The Green U.S. Pat. No. 4,376,596 discloses a portable roadway for use during periods of adverse weather conditions during which soil conditions are such that it is impossible to build a permanent road. This device will give motor vehicles traction in an area in which there would otherwise be none. It consists of a plurality of sections removably interconnected to each other by way of a latch and hook. Each section is constructed with a hardwood frame which supports a plywood surface.

The Arciszewski U.S. Pat. No. 4,681,482 discloses a rollable temporary roadway and apparatus for rolling up an installed temporary roadway. A temporary secure roadway enables vehicles to travel thereon when the soil conditions would not otherwise permit, which consists of supporting elements that are connected by hinge means. Two cables are situated on each side of the support elements and are integrated into the hinges to provide greater strength while supporting a load. There is also a reeling device which is used to roll up the roadway when its use is complete, and consists of an axle pipe with a rotary bearing on either end.

The Hughes U.S. Pat. No. 3,820,912 discloses a mobile collapsible ramp which consists of two sets of blocks, each of which are coupled to each other in a chain and are removably fixed to the ground. The first set of blocks are laid parallel to the second set, and each block has an upper surface for accommodating a vehicle wheel. This relates particularly to a mobile collapsible personal boat ramp.

The Boswell U.S. Pat. No. 4,176,982 discloses a bicycle path transport system.

The Pine U.S. Pat. No. 4,254,907 discloses a portable traction track for a vehicle driving wheel.

SUMMARY OF THE INVENTION

It is an object of the present invention to provide a portable track device for wheelchairs such that the occupant of the wheelchair can safely travel across the sand at a beach or some other difficult terrain.

It is a further object of the invention to provide a portable track device for wheelchairs, which device consists of several tracks, preferably six, three for each side: each track is several feet long, preferably six feet, and is constructed of a lightweight plastic reinforced by metal such as aluminum or steel rods, and the tracks have a coupling means to interlock with each other to create a rail-like track.

The above objects are accomplished in accordance with the present invention by providing a set of two parallel tracks upon which a wheelchair can be moved. The wheelchair has a length and the track comprises at least two track sections placed in tandem, one behind the other, and each set being parallel to the other track set. Each track section has a length at least equal to the length of the wheelchair, and there are two parallel tracks with one length of track on each side of the wheelchair. The front and back wheel on one side of the wheelchair are designed to travel within the track on that side. The front and back wheels on the other side of the wheelchair are designed to travel within the parallel track on the other side of the wheelchair.

BRIEF DESCRIPTION OF THE DRAWINGS

Other objects and features of the present invention will become apparent from the following detailed description considered in connection with the accompanying drawings which disclose the embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
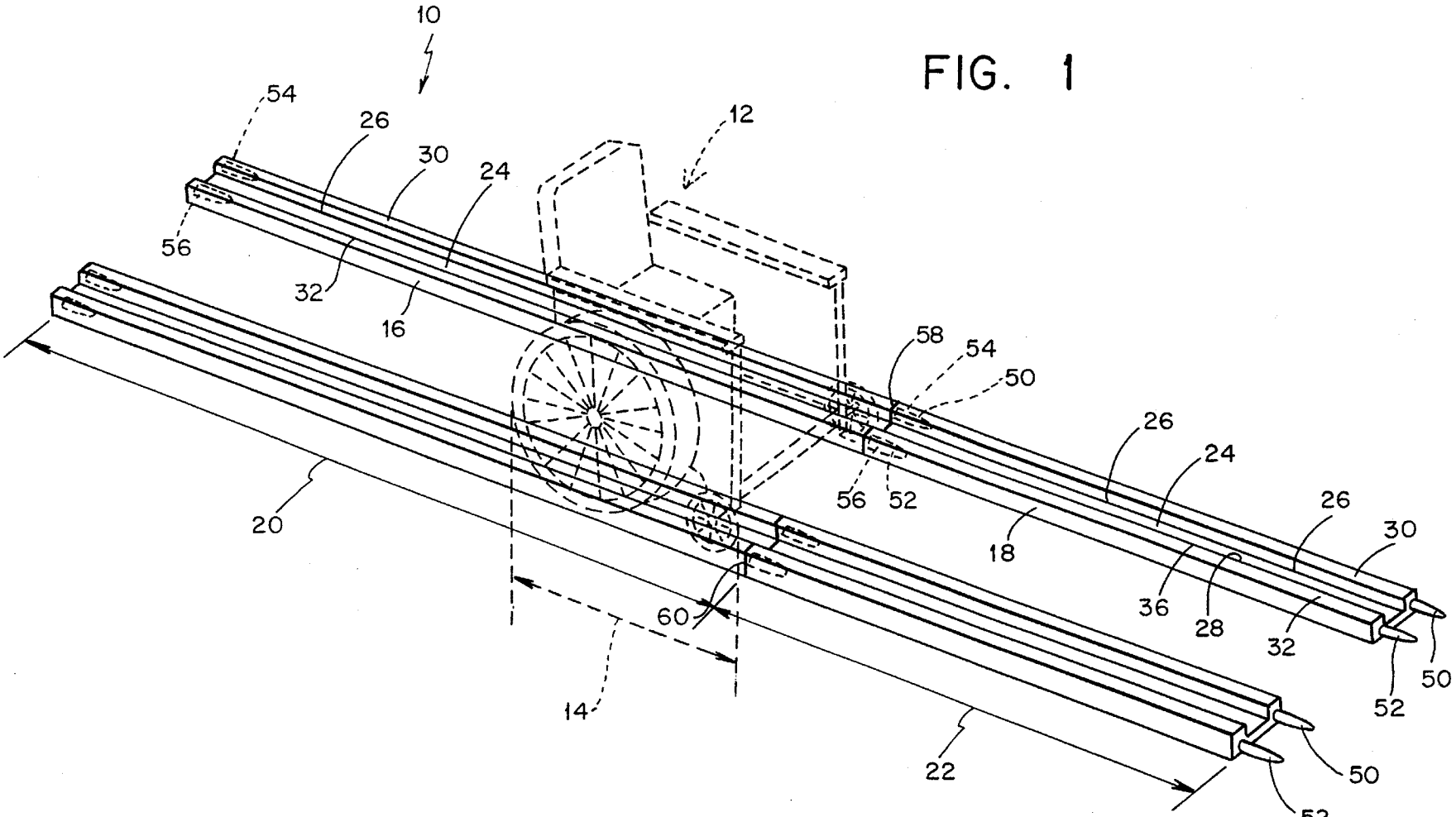
FIG. 1 shows a top perspective view of a set of two parallel sections of track for a wheelchair according to the invention.

Turning now in detail to the drawings, FIG. 1 shows a set of two portable tracks 10 and **10*a* upon which a wheelchair 12 can be moved, with the wheelchair having a length 14, the track including at least two track sections 16 and 18 placed in tandem adjacent to each other, and one behind the other. The length 14 of the wheelchair is the total distance from the back of the rear wheel to the front of the front wheel. Because track 10 and track 10*a* are identical to each other, only the one track 10** has all the reference numerals placed thereon, for the sake of brevity.

The track sections have lengths 20 and 22, respectively, at least equal to the length 14 of the wheelchair 12. Preferably, each track section has a length greater than the length of the wheelchair. Each track section has a bottom channel 24 having a right edge 26 and a left edge 28. A right sidewall 30 is attached to the right edge 26 of the bottom channel and extends above the bottom channel. A left sidewall 32 is attached to the left edge 28 of the bottom channel and extends above the bottom channel. The right sidewall 30 has a length 34. The left sidewall 32 has a length 36.

Figure 2:
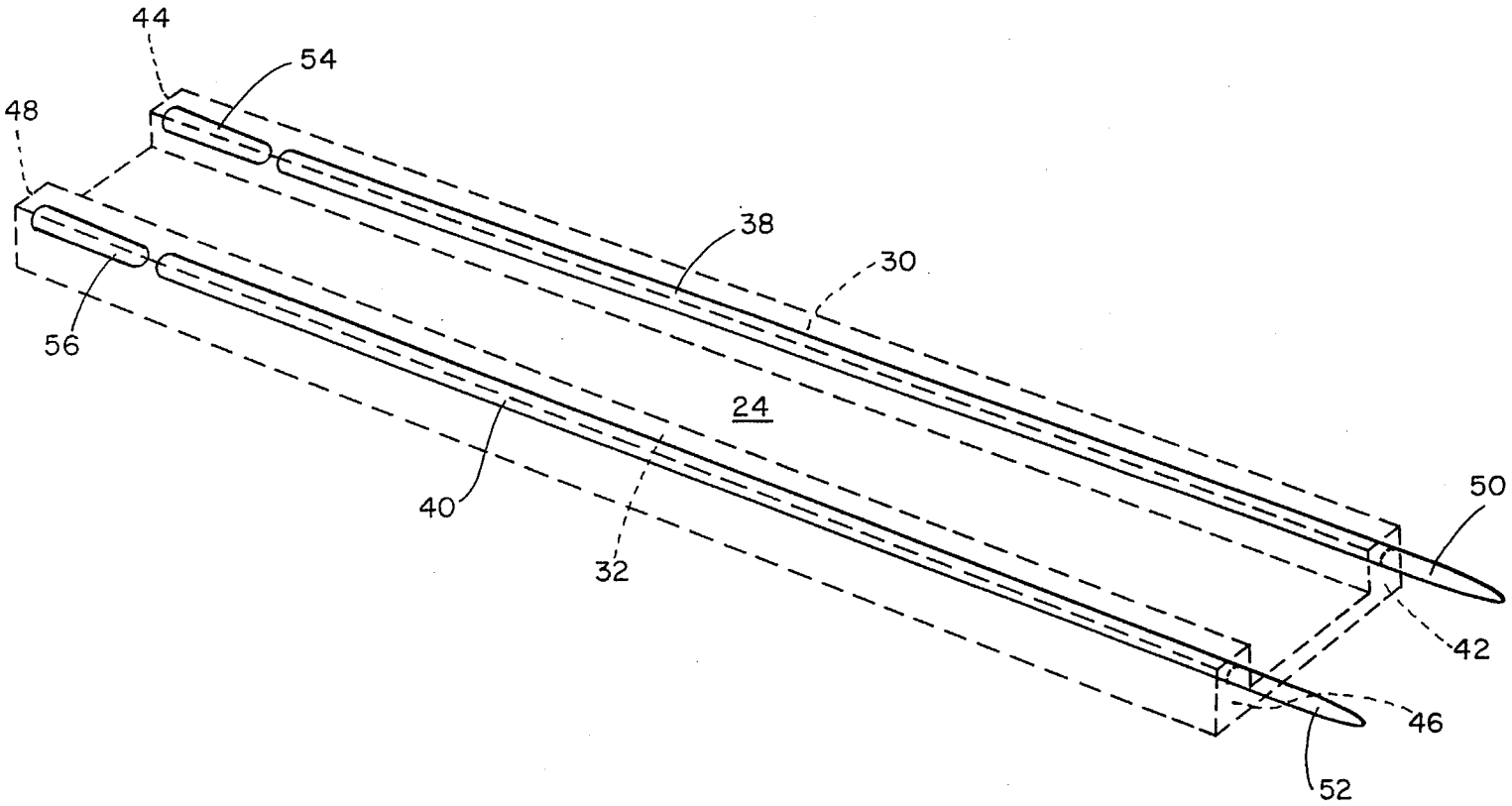
FIG. 2 shows a top perspective view of one track section of FIG. 1 containing reinforcing rods for connecting the side walls at one track section to another.
Figure 3:
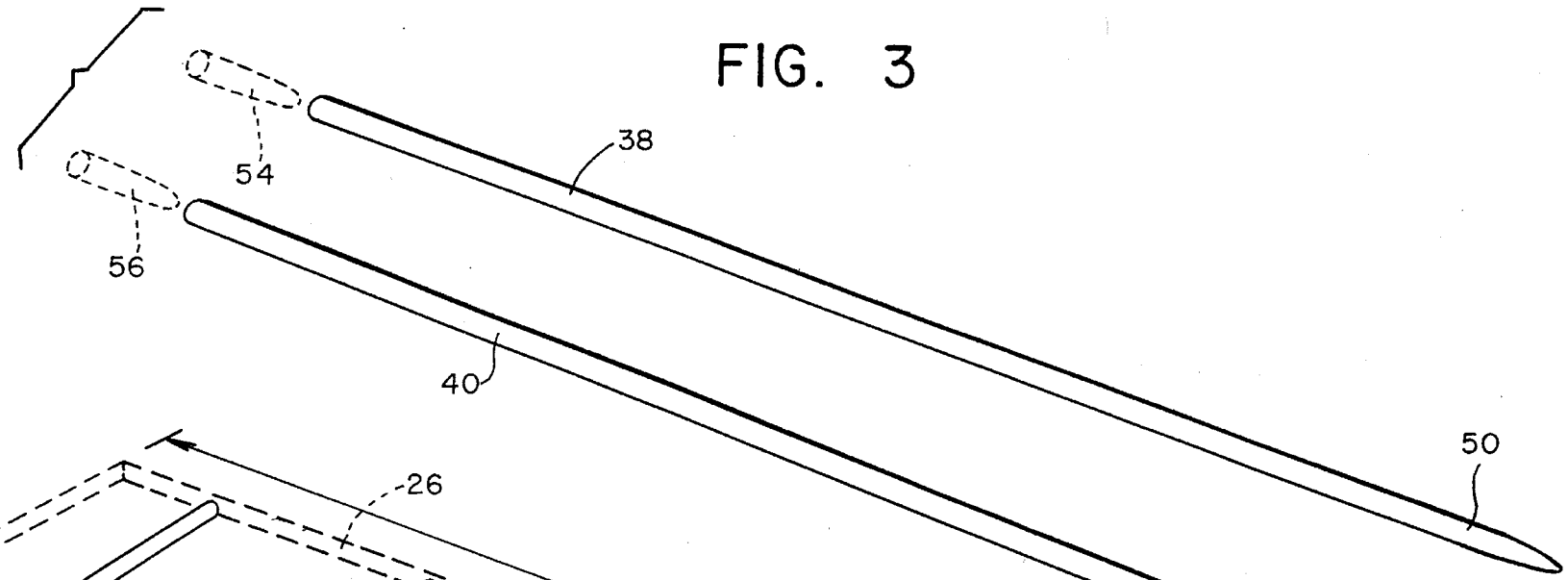
FIG. 3 shows the reinforcing rods of FIG. 2.

FIGS. 2 and 3 show a right side reinforcement rod 38 within the right sidewall 30 extending along the length of the right sidewall, and shows a left side reinforcement rod 40 within the left sidewall 32 extending along the length of the left sidewall. The right sidewall 30 has a front end 42 and a back end 44. The left sidewall 32 has a front end 46 and a back end 48. The right side reinforcement rod 38 has a protrusion 50 extending from the front end 42 of the right sidewall 30. The left side reinforcement rod 40 has a protrusion 52 extending from the front end 46 of the left sidewall 32. The right sidewall has a cavity 54 in the back end 44. The left sidewall has a cavity 56 in the back end 48.

FIG. 1 shows the manner by which a first track section 16 is attached to a second track section 18 by a coupling means 58 and 60 comprising the protrusion 50 extending from the front end of the right sidewall 30 of the first track section 16 retained within the cavity 54 of the right sidewall 30 of the second track section 18, and the protrusion 52 extends from the front end of the left sidewall 32 of the first track section 16 retained within the cavity 56 of the left sidewall 32 of the second track section.

Figure 4:
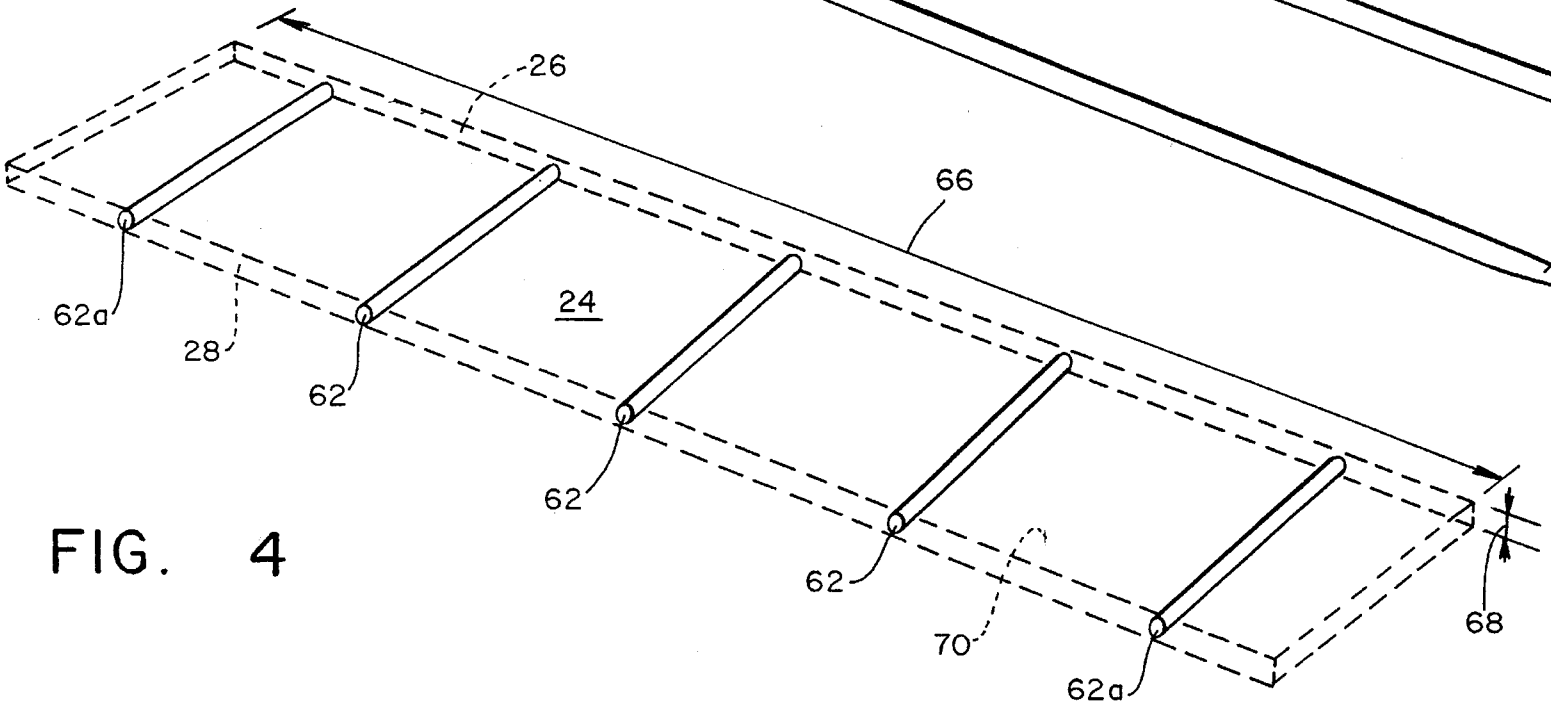
FIG. 4 shows a further embodiment in which transverse rods are present in the central channel trough floor of the track section of FIG. 2.

As shown in FIG. 1, the bottom channel 24 is wide enough to permit the unobstructed passage of the wheelchair set of front wheel plus rear wheel on one side of the wheelchair between the right and the left sidewalls. FIG. 4 shows another embodiment wherein the bottom channel has transverse supports 62 for reinforcing the bottom channel. The transverse supports are positioned a spaced distance 64 apart from each other along the length 66 of the bottom channel. Also, the bottom channel has a thickness 68 and a top surface 70 which contacts the wheelchair. The transverse supports 62 are contained within the thickness 68 of the bottom channel 24 below the top surface 70 of the bottom channel.

In a further embodiment, some of the transverse supports 62*a* (FIG. 4) protrude above the top surface 70 of the bottom channel adjacent to the front ends 42 and 46 of the sidewall and adjacent to the back ends 44 and 48 of the sidewall (FIG. 2) to prevent unintended movement of the wheelchair. The right sidewall 30 is perpendicular to the bottom channel and the left sidewall 32 is perpendicular to the bottom channel.

Figure 5:
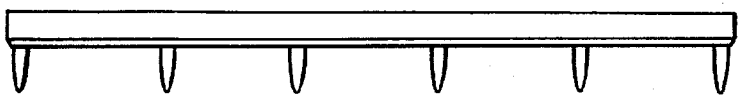
FIG. 5 shows ground gripping means for the track.

FIG. 5 shows a gripping means 80 which includes a supporting beam 82 having a self-adhesive top surface 84 and having gripping spikes 86 on the bottom surface 88. Preferably, the beam 82 is 6 feet long and 4 inches wide, with one-inch-long spikes 86 spaced 3 inches apart. Gripping means 80 are attached to the bottom 90 (FIG. 2) of track 10 or 10*a* on each section of track.

Preferably, the portable track sections are made of a strong, lightweight plastic material, such as a thermoplastic, like polyvinyl chloride, or a polyolefin, like polyethylene. Also, the track sections could be made from a thermosetting resin such as phenol formaldehyde, and by such procedures as injection molding or extruding. The reinforcement rods 38 and 40 can be made of metal such as aluminum, brass, or steel. The transverse supports 62 and 62*a* can also be made of metal such as aluminum, brass or steel.

In a preferred embodiment, the dimensions of each track section include the bottom channel 24 being 4 inches wide and 1 inch for thickness 68, with each side wall 30 and 32 being 2 inches high and 1 inch wide rising 1 inch above channel 24. Each track section is 6 feet in length.

The method for utilizing the portable wheelchair tracks of the invention is to assemble at least two, and preferably three, track sections in tandem and interconnected with the protrusion of each sidewall coupled into the cavity of an adjacent sidewall. Thus, the track sections extend on one side of the wheelchair for one set of wheels across the sandy terrain in the direction of intended movement of the wheelchair. A second set of parallel track sections for the wheels on the other side of the wheelchair is provided. The wheelchair is then moved along the two parallel sets of tracks from the track back section to the track front section.

After the wheelchair is brought to a halt at the track front section, the track back section, or sections, is uncoupled and is then brought around to the track front section and is reconnected to this front section. This occurs for both sets of parallel tracks. Thus, this front section upon which the wheelchair is halted then becomes the track back section and the previous back section becomes the new front track section. The wheelchair is then moved from this back track section onto the new front track section and halted thereon. The back track section is uncoupled from the front track section, and is repositioned and reconnected in front of the front track section. This occurs for both sets of parallel tracks. This alternative movement of the wheelchair followed by relocation of the track sections is repeated until the wheelchair is positioned where it is finally desired to be located. Having each track section being greater in length than the length of the wheelchair makes it possible to uncouple and recouple the track sections in a very efficient manner. Also, having transverse supports 62*a* protruding above the top surface 70 of the bottom channel adjacent to the front end and the rear end of the track section has the advantage of preventing unintended movement of the wheelchair off of the track section where the terrain may be at an incline to the horizontal.

These two sets of parallel track sections are preferably not interconnected to each other.

While several embodiments of the present invention have been shown and described, it is to be understood that many changes and modifications may be made thereunto without departing from the spirit and scope of the invention as defined in the appended claims.

What is claimed is:

1. A track upon which a wheelchair can be moved, said wheelchair having a length, said track comprising at least two track sections placed in tandem, one behind the other, and adjacent to each other;

each track section having a length at least equal to the length of the wheelchair;

wherein each track section comprises a bottom channel having a right edge and a left edge;

a right sidewall attached to said right edge of said bottom channel and extending above said bottom channel;

a left sidewall attached to said left edge of said bottom channel and extending above said bottom channel;

wherein the right sidewall has a length;

wherein the left sidewall has a length;

a right side reinforcement rod within the right sidewall extending along the length of said right sidewall; and a left side reinforcement rod within the left sidewall extending along the length of said left sidewall.

2. The track of claim 1, wherein each track section has a length greater than the length of the wheelchair.

3. The track of claim 1, wherein the right sidewall has a front end and a back end;

wherein the left sidewall has a front end and a back end;

wherein the right side reinforcement rod has a protrusion extending from the front end of said right sidewall; and wherein the left side reinforcement rod has a protrusion extending from the front end of said left sidewall.

4. The track of claim 3, wherein the right sidewall has a cavity in the back end; and wherein the left sidewall has a cavity in the back end.

5. The track of claim 4, wherein a first track section is attached to a second track section by a coupling means comprising the protrusion extending from the front end of the right sidewall of said first track section retained within the cavity of the right sidewall of said second track section, and the protrusion extends from the front end of the left sidewall of said first track section retained within the cavity of the left sidewall of said second track section.

6. The track of claim 1, wherein said bottom channel has transverse supports for reinforcing said bottom channel.

7. The track of claim 6, wherein the bottom channel has a length; and wherein said transverse supports are positioned a spaced distance apart from each other along the length of the bottom channel.

8. The track of claim 6, wherein said bottom channel has a thickness and has a top surface which contacts said wheelchair; and wherein said transverse supports are contained within said thickness of said bottom channel below said top surface of the bottom channel.

9. The track of claim 8, wherein the transverse supports protrude above said top surface of said bottom channel adjacent to the front end of the sidewall and adjacent to the back end of the sidewall to prevent unintended movement of the wheelchair.

10. The track of claim 1, wherein said right sidewall is perpendicular to said bottom channel; and wherein said left sidewall is perpendicular to said bottom channel.

11. A set of two parallel tracks upon which a wheelchair can be moved, said wheelchair having a length, said set comprising a first track having at least two track sections placed in tandem one behind the other and adjacent to each other;

each track section having a length at least equal to the length of the wheelchair;

in combination with a second parallel track having at least two track sections placed in tandem, one behind the other, and adjacent to each other;

each track section of the second parallel track having a length at least equal to the length of the wheelchair;

wherein each track section comprises a bottom channel having a right edge and a left edge;

a right sidewall attached to said right edge of said bottom channel and extending above said bottom channel;

a left sidewall attached to said left edge of said bottom channel and extending above said bottom channel;

wherein the right sidewall has a length;

wherein the left sidewall has a length;

a right side reinforcement rod within the right sidewall extending along the length of said right sidewall; and a left side reinforcement rod within the left sidewall extending along the length of said left sidewall.

12. The set of two parallel tracks of claim 11, further comprising gripping means attached to the bottom of a track section.

* * * * *